United States Patent [19]

Forrest

[11] 4,403,555

[45] Sep. 13, 1983

[54] PALLET FOR USE IN HANDLING MATERIAL

[76] Inventor: John E. Forrest, 1617 - 22nd St., Manhattan Beach, Calif. 90266

[21] Appl. No.: 272,749

[22] Filed: Jun. 11, 1981

[51] Int. Cl.[3] ..... B65D 19/32

[52] U.S. Cl. ..... 108/51.1; 108/901

[58] Field of Search ..... 108/51.1, 53.1, 53.3, 108/55.1–55.5, 57.1, 901, 902, 56.1

[56] References Cited

U.S. PATENT DOCUMENTS

| | | | |
|---|---|---|---|
| 3,664,271 | 5/1972 | Wolder et al. | 108/51.1 |
| 3,667,403 | 6/1972 | Angelbeck, Jr. | 108/51.1 |
| 3,685,464 | 8/1972 | Ranno | 108/901 X |
| 3,868,915 | 3/1975 | Hafner | 108/53.1 X |
| 4,183,491 | 1/1980 | Sanders et al. | 108/51.1 X |
| 4,316,419 | 2/1982 | Cupido | 108/901 X |

*Primary Examiner*—William E. Lyddane
*Attorney, Agent, or Firm*—Edward A. Sokolski

[57] ABSTRACT

A pallet for the handling and transportation of material which is molded of plastic. The pallet is fabricated from a top and base, these two generally similar molded half sections being joined together to form an integral unit. Each such section has a border frame with diagonal stringers running between portions of the frame, there being two sets of stringers, the stringers of one set being orthogonal to those of the other, to form a structural lattice. There are a greater number of stringers (typically twice as many) in one set of stringers than the other. The set of stringers having the greater number of stringer elements on the top section runs parallel to the set of stringers having the lesser number of stringer elements on the base section, and vice-versa, to afford higher structural integrity to the assembled unit. Post or leg members extend inwardly from each section and are joined together at the interface between opposing such leg members to form structural trusses between the structural lattices.

Four apertures are provided in the base section to receive the rollers of the tines of a handjack with entry from any of the four sides; these apertures being formed by ringed portions equally spaced between the legs of each quadrant of the base half section. Such base ringed portions have interlocking base tabs formed thereon which mate with corresponding top tab recesses on similar ringed portions formed in the top lattice section which does not have apertures, thereby facilitating the stacking of the unloaded pallets.

13 Claims, 7 Drawing Figures

PALLET FOR USE IN HANDLING MATERIAL

This invention relates to pallets for use in handling and transporting material, and more particularly to such a pallet which is molded from plastic.

Pallets have been used for quite a number of years in the handling and transportation of material, particularly in conjunction with forklift trucks. For many years, such pallets have generally been fabricated of wood with all of the disadvantages inherent in wood, such as warpage, splitting, splintering, lower than the desired strength-to-weight ratio, increase in weight when wet, etc. Further, in recent years, the price of wood has gone up considerably, escalating the cost of wooden pallets, particularly when considering their lack of durability as compared with pallets fabricated of other materials.

To overcome these various shortcomings of wood, pallets fabricated of molded plastic have been developed. Such prior art plastic pallets are described in the following U.S. Pat. Nos.: 3,699,901 to Cook; 3,467,032 to Rowlands et al.; 3,868,915 to Hafner; 3,702,100 to Wharton; 3,964,400 to Brand; and 4,013,021 to Steinlein et al. Each of the pallets of the aforementioned patents, while obviating the disadvantages inherent in wooden pallets as outlined above, has certain shortcomings of its own which the device of the present invention overcomes. Firstly, while some of these devices have some degree of improved strength-to-weight ratio over most wooden pallets, the device of the present invention affords a distinct advantage in this regard over the devices of the prior art. Further, the device of the present invention, while of extremely lightweight construction, has a very high structural integraity (higher strength-to-weight ratio) enabling it to handle bearing, compression, flexure and shear loads of a very high order. Still further, the device of the present invention is designed such that both top and base sections can be made from a single mold (with minor modifications to the mold in fabricating each section) making for more economical tooling and facilitating the fabrication.

The improvement is achieved in the device of the present invention by fabricating the pallet from two similar sections which are joined together in opposing relationship. Each section has a flat portion in the form of a structural lattice composed of two sets of diagonal stringers which run between the frame portion, with the first set of stringers running orthogonally to the second set and having a substantially greater number of stringer elements with closer spacing therebetween than the second set. Extending from the lattice along the frame thereof are a plurality of large round spaced leg or post members, these leg members preferably being placed at the four corners of the frame and at points along the frame halfway between the corner legs, as well as an additional large round leg at the center of the lattice. The leg members of the two lattice sections are joined together along their opposing edges to form the integral pallet unit. For increased structural integrity, the lattice stringer portion having the greater number of stringer elements of one section runs parallel to the lattice stringer portion of the other section having a lesser number of stringer elements, and vice versa. Further, in the base section, four quadrant apertures are formed in the lattice by means of four quadrant ring portions to facilitate the entry of a pair of tine rollers of a handjack from any of the four sides of this pallet.

It is therefore an object of this invention to provide a plastic pallet having a higher strength-to-weight ratio than prior art such devices.

It is a further object of this invention to provide a plastic pallet which is more economical and easier to fabricate than certain prior art such devices.

It is still a further object of this invention to provide a plastic pallet which can be easily stacked in uniformly indexed fashion by four quadrant interlocking ring portions when not in use and during shipment.

It is still another object of this invention to provide a loading shock mount on the base member of a plastic pallet in each quadrant thereof to enable deflection of the base lattice to equally load the legs of such pallet.

Other objects of this invention will become apparent as the description proceeds in connection with the accompanying drawings of which:

Figure 1:
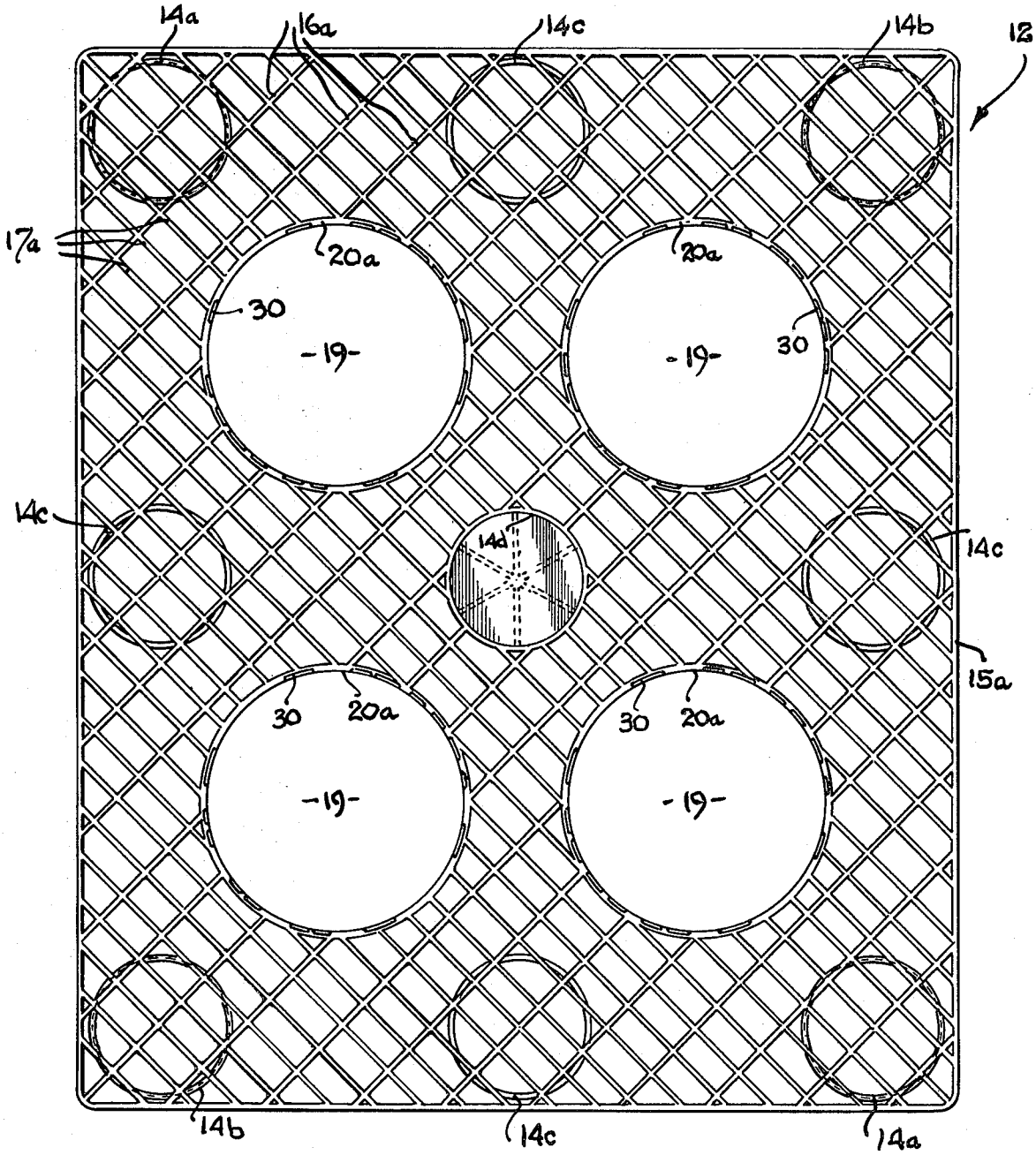
FIG. 1 is a bottom view of the base section of a preferred embodiment of the invention.

Referring now to the figures, a preferred embodiment of the invention is illustrated. For convenience of illustration, the upper and lower sections of the pallet have been shown separately in FIGS. 3 and 1, respectively, the integral unit with the top and bottom sections joined together being shown in FIGS. 2, 4 and 5. The pallet is formed with a top section 11 and a base section 12 which are basically similar and which are joined together at the interface between their respective leg portions **14*a*–14*d* by suitable means, such as cementing, as can best be seen in FIGS. 2 and 5. Leg portions 14*a* and 14*b* have interlocking male and female tabs while legs 14*c* and 14*d* employ butt joints without such tabs. Lower pallet half section 12, as can best be seen in FIG. 1, is molded from a high impact plastic and comprises a frame portion 15*a* forming a perimeter therearound with a first set of diagonal stringers 16*a* running diagonally between portions of the frame and a second set of stringers 17*a* also running diagonally between portions of the frame but orthogonal to stringers 16*a*. In the preferred embodiment, there are approximately twice as many stringer elements 17*a* as there are stringer elements 16*a* and the distances between elements 16*a* are twice that between elements 17*a*. The stringers 16*a* and 17*a* form a structural lattice between frame 15*a*** with the stringer elements being integrally joined together where they cross each other.

Extending inwardly from the inner surface of the lattice network are a plurality of leg portions **14*a*, 14*b*, 14*c* and 14*d*. These leg portions are integrally formed with the lattice with one such leg portion being at each corner of the lattice, one such leg being at the center of the lattice and one such leg being along the frame 15*a* halfway between each of the corners of the lattice. Four apertures 19 are formed in the lattice by means of ring portions 20***a* which are integrally formed with the lattice structure and provide reinforcement therefor.

Figure 2:
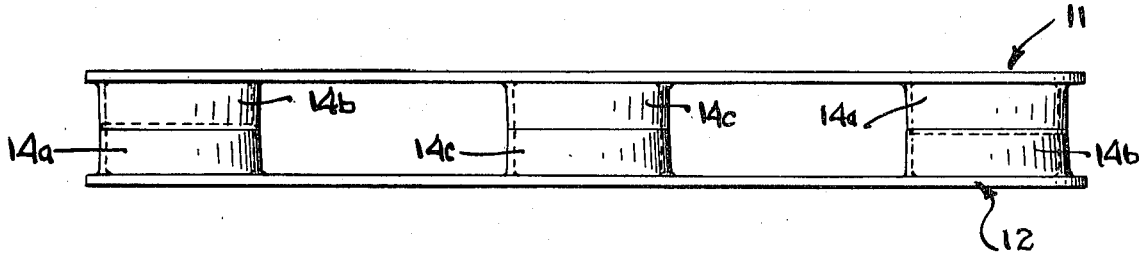
FIG. 2 is an elevational view of the preferred embodiment showing both top and base sections joined together.
Figure 3:
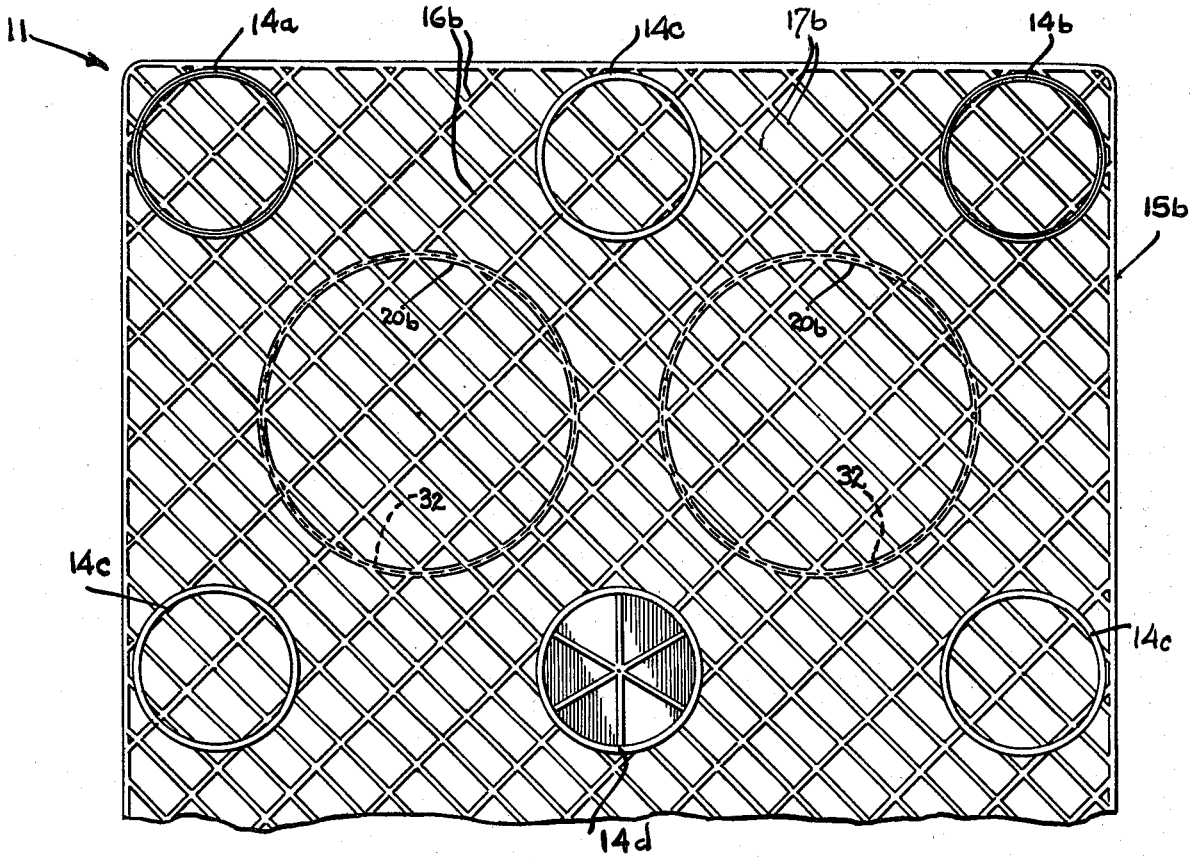
FIG. 3 is a bottom view of the top section of the preferred embodiment.
Figure 4:
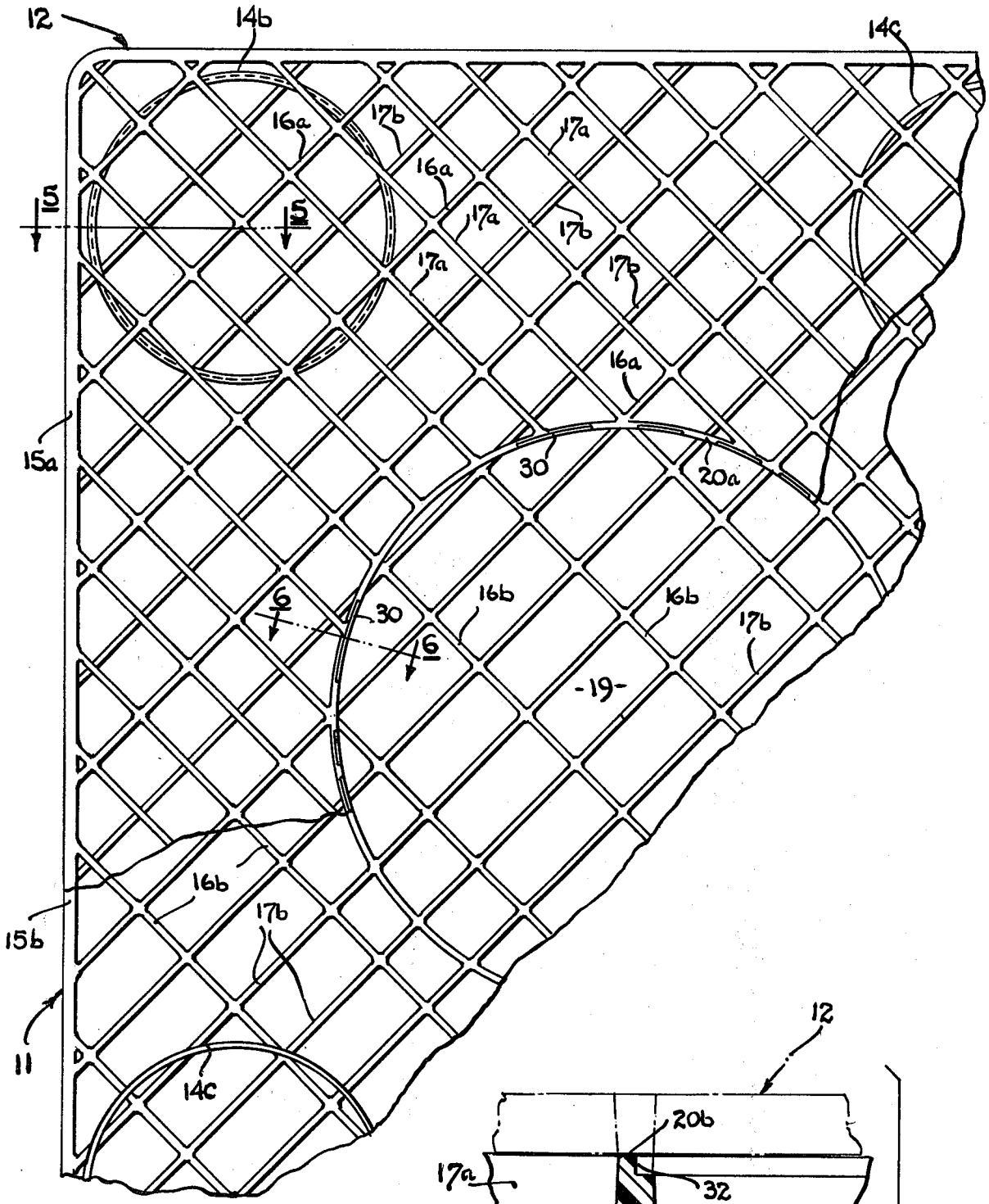
FIG. 4 is a bottom view of a corner section of the preferred embodiment.

The top half section 11 of the pallet has a structural lattice similar to that of the bottom half section with orthogonally related stringers 16*b* and 17*b* running between portions of frame 15*b* and leg portions 14*b* extending from the inner surface of the lattice in positions therealong corresponding to those of leg portions 14*a, b, c* and *d* of pallet section 12. Four reinforcing top ring members 20*b* are integrally formed in the lattice of pallet section 11, these ring members not forming apertures, as in the case of base ring members 20*a*, but being positioned in portions of the associated lattice four quadrants corresponding to the positions of base ring members 20*a*. The two sections 11 and 12 are joined together at the abutting ends of leg portions 14*a*, 14*b*, 14*c* and 14*d* to form an integral pallet unit as shown in FIGS. 2, 4 and 5.

Figure 5:
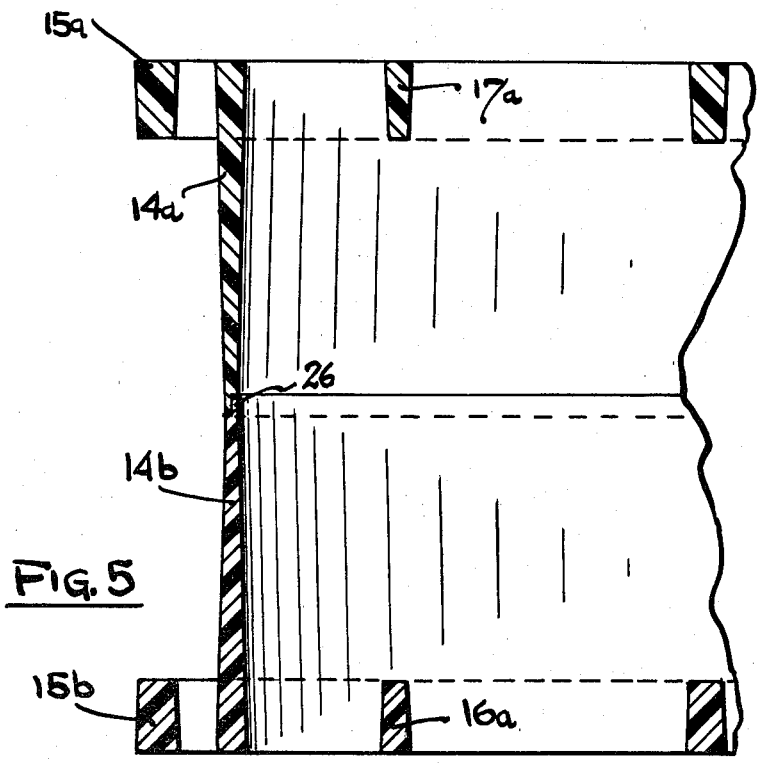
FIG. 5 is a cross-sectional view taken along the plane indicated by 5—5 in FIG. 4.

As can best be seen in FIG. 5, leg portions 14*a*–14*d* are generally cylindrical in form and are inwardly tapered in the direction running from their respective lattices. Leg portions 14*a* and 14*b* have male/female mating undercut portions at their extreme ends which matingly abut against each other to form a lap joint 26, cement being applied at this joint to integrally join the legs togehter.

Figure 6:
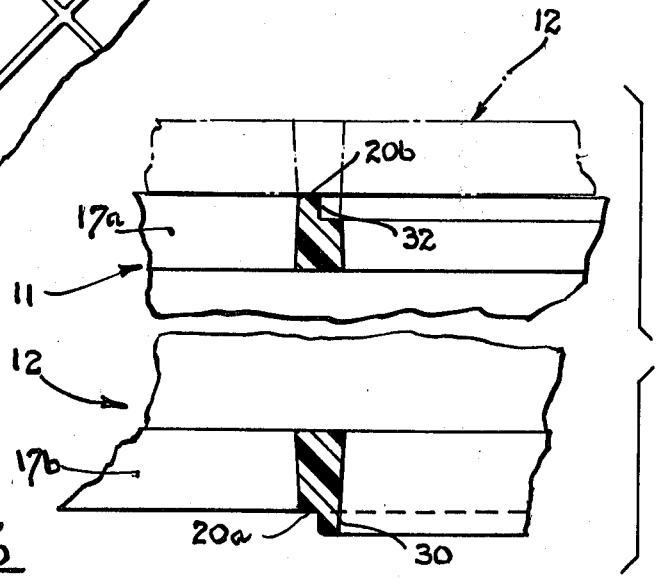
FIG. 6 is a cross-sectional view taken along the plane indicated by 6—6 in FIG. 4.

As already noted, apertures 19 form convenient openings for handjack center rollers. Ring portions of the top section 20*a* not only provide reinforcement for the lattice structure to accept and distribute concentrated loads equally into the quadrant legs, but also have intermittent recessed ring flange members 30 formed therein which matingly engage the lattice structure and the rim portions 32 of a corresponding intermittent extended flange ring portion 20*b* of the base half section of another pallet, for use in the stacking of pallets, as shown in FIG. 6. Flange members 30 also function as shock mounts which deflect to cushion loads which may be dropped on the pallet and operate with their associated rings to equally distribute such load deflections to the pallet legs.

It is to be noted that in its assembled form, the lattice stringers 16*a* having the wider separation of one half section and the wider spaced lattice stringers 16*b* of the other half section run orthogonally to each other while similarly the closer spaced stringers 17*a* on one half section run orthogonally to the closer spaced stringers 17*b* of the other half section.

Figure 5A:
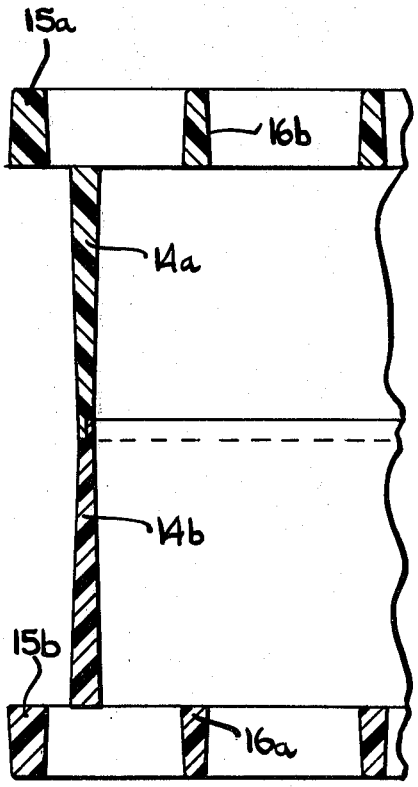
FIG. 5A is a cross-sectional view in elevation showing an alternate construction for the leg members.

Referring now to FIG. 5A, an alternate type of construction for the leg members 14*a* and 14*b* is shown. In this alternate construction, the leg members do not extend through the lattice stringers 16*a*, 16*b* and 17*a*, 17*b*, but rather are joined to the inner surfaces thereof. This type of construction has advantages for certain application requirements.

The device of the invention thus provides a high strength-to-weight ratio pallet which is relatively lightweight and easy to handle and which can readily be stacked for storage or shipping. The device is adapted for fabrication from a single mold in two half sections which are then integrally joined together to form a unitized integral unit, thus making for a simple economical high strength-to-weight ratio construction.

While the device has been described and illustrated in detail, it is to be clearly understood that this is intended by way of illustration and example only and is not to be taken by way of limitation, the spirit and scope of the invention being limited only by the terms of the following claims.

I claim:

1. A pallet for use in the handling and transportation of material comprising a top half section including an edge border frame and first and second sets of stringers running diagonally between said frame to form a lattice truss structure, the stringers of said first set being substantially parallel to each other, the stringers of said second set being substantially parallel to each other and orthogonal to the stringers of said first set, there being a substantially greater number of stringers in the second set than the first set, and a plurality of spaced apart leg members extending normally from the surface of said lattice structure, and a base half section having a lattice structure with a frame and first and second sets of diagonal stringers similar to that of said first half section and having a plurality of similar spaced apart leg members extending normally from its lattice structure, and positioned on the associated lattice structure in the same manner as the positioning of the leg members of the first half section on its associated lattice structure, said top and base half sections being joined together to form an integral unit with the ends of corresponding leg members of said sections joined in abutment with each other to form a plurality of leg truss members running between the lattice structure, the second set of stringers of said top half section running orthogonally to the first set of stringers of the base half section and the first set of stringers of the top half section running orthogonally to the second set of stringers of the base half section.

2. The pallet of claim 1 wherein there are approximately twice as many lattice truss structure stringers in the second sets than the first sets thereof.

3. The pallet of claim 1 or 2 wherein the lattice truss structure of said base half section has a plurality of apertures formed in the lattice structure thereof, said apertures being formed by reinforcing ring portions of said lattice truss structure, said apertures being adapted to receive the tine roller members of a handjack.

4. The pallet of claim 3 wherein there are lattice reinforcing ring portions in the lattice structure of said top half section directly opposite the ring portions of the lattice of said base half section.

5. The pallet of claim 4 wherein said lattice structures are both substantially rectangular in form, there being one of said ring portions in each of the four quadrants of each of said lattice structures.

6. The pallet of claim 5 and further including intermittent flanges formed in the ring portions of said lattice structures, the flanges of the ring portions of the top half section being adapted to mate with the flanges of the ring portions of the lattice structure of the base half section of another pallet to facilitate the stacking of the pallets for storage and shipping.

7. The pallet of claim 6 wherein the flanges formed in the ring portions of the lattice structure of the base half section form shock mounts to cushion and equally distribute loads to the legs of the pallet.

8. The pallet of claim 1 wherein there is one of said leg members positioned at each of the corners of the lattice truss structures.

9. The pallet of claim 8 wherein there is one of said leg members positioned along the frames halfway between each of the leg members positioned at said corners.

10. The pallet of claim 9 wherein there is one of said leg members positioned at the center of each of said lattice structures.

11. The pallet of claim 10 wherein the leg members of the top half section positioned halfway between the corner leg members and at the center of the lattice structures are joined together along their edges in a butt joint with the corresponding leg members of the base half section.

12. The pallet of claim 1 wherein the abutting ends of said corner positioned leg members have male/female mating undercut portions which are joined together in interlocking relationship.

13. The pallet of claim 1 wherein the leg members are cylindrical.

* * * * *